US010088194B2

(12) United States Patent
Cocks et al.

(10) Patent No.: US 10,088,194 B2
(45) Date of Patent: Oct. 2, 2018

(54) SYSTEMS FOR AND METHODS OF DIRECTING AIRFLOW IN AIR HANDLING SYSTEMS

(71) Applicant: Regal Beloit America, Inc., Beloit, WI (US)

(72) Inventors: Rachele Barbara Cocks, Columbia City, IN (US); Kamron Mark Wright, Fort Wayne, IN (US); Kerry Baker Shelton, Fort Wayne, IN (US); Joshua James Westhoff, Fort Wayne, IN (US)

(73) Assignee: Regal Beloit America, Inc., Beloit, WI (US)

( * ) Notice: Subject to any disclaimer, the term of this patent is extended or adjusted under 35 U.S.C. 154(b) by 1031 days.

(21) Appl. No.: 14/446,954

(22) Filed: Jul. 30, 2014

(65) Prior Publication Data

US 2016/0033164 A1 Feb. 4, 2016

(51) Int. Cl.

| | |
|---|---|
| ***F15D 1/00*** | (2006.01) |
| ***F24F 13/24*** | (2006.01) |
| ***F24F 13/02*** | (2006.01) |
| ***F24F 13/08*** | (2006.01) |

(52) U.S. Cl.

CPC ..... *F24F 13/24* (2013.01); *F24F 13/02* (2013.01); *F24F 13/08* (2013.01)

(58) Field of Classification Search

CPC .. F24F 13/00; F24F 13/02; F24F 13/08; F24F 13/24

USPC ..... 454/264, 262, 346

See application file for complete search history.

(56) References Cited

U.S. PATENT DOCUMENTS

| | | | | |
|---|---|---|---|---|
| 3,362,469 | A | 1/1968 | Berner et al. | |
| 4,576,549 | A | 3/1986 | Lanier | |
| 4,750,693 | A | 6/1988 | Lobert et al. | |
| 5,285,350 | A * | 2/1994 | Villaume | H01L 23/3672 165/80.3 |
| 5,316,439 | A | 5/1994 | Gatley et al. | |
| 5,868,551 | A | 2/1999 | Smiley, III et al. | |
| 6,039,532 | A | 3/2000 | McConnell | |
| 7,591,633 | B2 | 9/2009 | Hancock | |
| 8,151,931 | B2 | 4/2012 | Eaton et al. | |
| 8,537,548 | B2 | 9/2013 | Bhattacharya et al. | |
| 2007/0059167 | A1 | 3/2007 | Hancock | |

(Continued)

FOREIGN PATENT DOCUMENTS

| | | | |
|---|---|---|---|
| DE | 2933358 | A1 | 2/1981 |
| DE | 102006020312 | A1 | 11/2007 |

(Continued)

OTHER PUBLICATIONS

Office Action dated Oct. 20, 2016, U.S. Appl. No. 14/280,121; Regal Beloit America, Inc., 15 pages.

(Continued)

*Primary Examiner* — Gregory Huson
*Assistant Examiner* — Dana Tighe
(74) *Attorney, Agent, or Firm* — Armstrong Teasdale LLP

(57) ABSTRACT

An air handling system comprises a housing and a fan configured to circulate air. The housing comprises at least one wall defining a passageway for the air and at least one vortex generator coupled to the at least one wall. The at least one vortex generator extends partially into the passageway.

17 Claims, 7 Drawing Sheets

(56) References Cited

U.S. PATENT DOCUMENTS

| | | | | |
|---|---|---|---|---|
| 2008/0062644 | A1* | 3/2008 | Petroski | F04D 33/00 361/695 |
| 2009/0232648 | A1 | 9/2009 | Wu | |
| 2015/0337862 | A1 | 11/2015 | Rao | |

FOREIGN PATENT DOCUMENTS

| | | | |
|---|---|---|---|
| JP | 2002147789 | A | 5/2002 |
| JP | 2005351205 | A | 12/2005 |
| JP | 2007138844 | | 6/2007 |

OTHER PUBLICATIONS

European Extended Search Report, Application No. 15167726.7, dated Dec. 16, 2015, pp. 9.

Reichert, Bruce, A. et al., An Experimental Investigation of S-Duct Flow Control Using Arrays of Low Profile Vortex Generators, NASA, NASA Technical Memorandum 106030, 16 pages.

* cited by examiner

SYSTEMS FOR AND METHODS OF DIRECTING AIRFLOW IN AIR HANDLING SYSTEMS

BACKGROUND

The field of this disclosure relates generally to air handling systems, and more specifically, to directing airflow in heating, ventilating, and air conditioning (HVAC) systems that include the use of vortex generators.

Some known HVAC systems utilize centrifugal fans or other air handling apparatus to circulate air through ductwork systems and deliver conditioned air to a space. To circulate air, centrifugal fans in HVAC systems push large amounts of air through the fan housing and into attached ductwork systems. The centrifugal fans may generate unfavorable flow structures, such as, for example, large swirling vortexes of air. Additionally, unfavorable flow structures can be generated wherever the air is redirected, such as at turns in the ductwork system or at vanes. The unfavorable flow structures generate noise and decrease the efficiency of HVAC systems. Therefore, a means to break up or prevent these unfavorable flow structures would decrease the sound and increase the efficiency of HVAC systems. As HVAC systems are often used in occupied spaces, the noise generated by an HVAC system can disturb the occupants of the conditioned space.

Systems for lessening the noise generated by HVAC systems are known in the art. In one such system, an acoustic wave modulator configured to reduce turbulence of the air is placed in a duct assembly adjacent a fan. The acoustic wave modulator has one or more fins attached to a cylindrical structure. The cylindrical structure acts as a hub and has an axis generally parallel with the direction of airflow. The acoustic wave modulator attempts to straighten the airflow, i.e., force the air to flow in only one direction, directly adjacent the fan. The acoustic wave modulator does not reduce all sound and is designed for use only adjacent the fan.

Alternatively, sound in HVAC systems can be reduced by placing active sound controls and/or filter media in the duct systems. However, the acoustic filter media and active sound controls can decrease efficiency of the HVAC system.

BRIEF DESCRIPTION

In one aspect, an air handling system comprises a housing and a fan configured to circulate air. The housing comprises at least one wall defining a passageway for the air and at least one vortex generator coupled to the at least one wall. The at least one vortex generator extends partially into the passageway.

In another aspect, a method of assembling an air handling system comprises providing a housing with a surface and an edge. A vortex generator including a plate having a face and an edge is provided. The vortex generator edge is coupled to the wall. The vortex generator face is oriented substantially perpendicular to the surface. The vortex generator edge is oriented to form an irregular angle with the wall edge.

In yet another aspect, a duct system for channeling airflow comprises at least one wall defining a passageway for channeling airflow. A vane is coupled to the at least one wall and spans substantially the entirety of the passageway. The vane has a panel with a surface for directing airflow. A vortex generator having a face is coupled to the vane surface.

DETAILED DESCRIPTION

Described below are vortex generators and methods of using vortex generators that help to break up unfavorable flow structures in flowing fluid. Alternately, vortex generators may be used to prevent the formation of large flow structures in flowing fluid by adding a momentum component to the flowing fluid. The momentum component creates an inertial resistance in the flowing fluid that hinders the formation of large flow structures. These vortex generators may be used in HVAC systems to increase the systems' efficiency and decrease sound generated by the systems.

Figure 1:
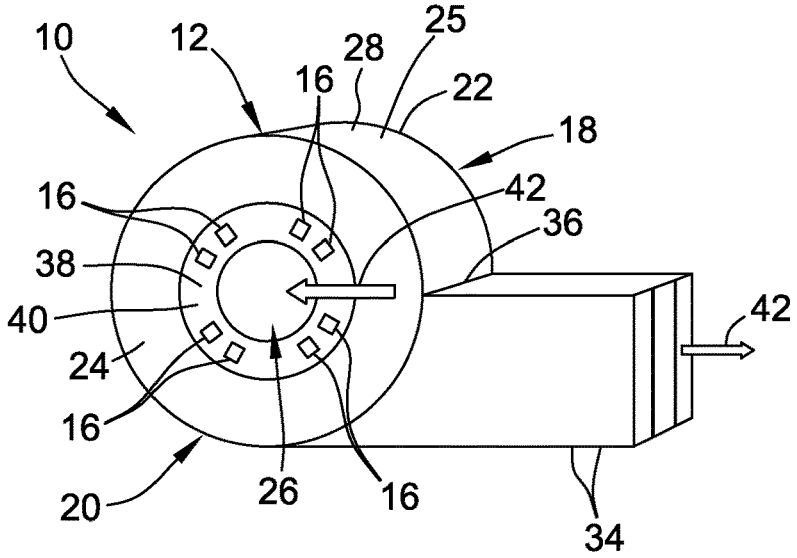
FIG. 1 is a perspective view of an air handling system.
Figure 2:
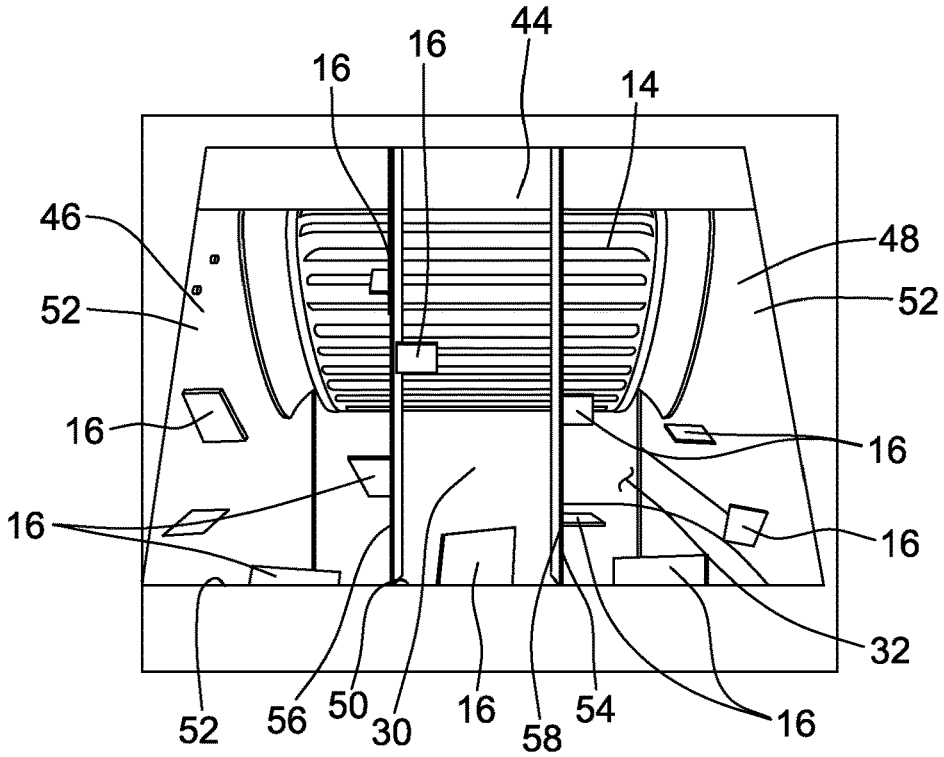
FIG. 2 is a front view of a portion of the air handling system shown in FIG. 1.

FIG. 1 illustrates an exemplary embodiment of an air handling system 10. Air handling system 10 includes a blower housing 12, a fan 14 inside blower housing 12, and vortex generators 16. FIG. 2 is a front view of a portion of air handling system 10. Blower housing 12 includes a motor side portion 18 and an inlet side portion 20. Motor side portion 18 has a sidewall 22 and inlet side portion 20 has a sidewall 24 having an air inlet opening 26 through which a volume of air is drawn by fan 14 to provide air to blower housing 12. In one embodiment, sidewall 24 is substantially planar. Additionally, in the exemplary embodiment, blower housing 12 includes a scroll wall 28 positioned between sidewall 22 and sidewall 24. Scroll wall 28 has an interior surface 30 and defines a circumference of blower housing 12. As such, scroll wall 28, sidewall 22, and sidewall 24 together define a blower chamber 32. Air handling system 10 includes an exhaust outlet 34 through which air blown by fan 14 is exhausted downstream of blower housing 12. Scroll wall 28 extends circumferentially from a cut-off point 36 about blower chamber 32 to exhaust outlet 34. Although blower housing 12 is illustrated as having only one inlet, outlet, and fan, blower housing 12 may include any number of inlets, outlets, and fans that enable blower housing 12 to function as described herein.

As shown in FIG. 1, blower housing 12 includes an exterior surface 25 and an air inlet opening 26 in sidewall 24. Vortex generators 16 may be coupled anywhere on exterior surface 25. In the exemplary embodiment, air inlet opening 26 includes an inlet ring 38 and vortex generators 16 coupled to inlet ring 38. Inlet ring 38 has a curved surface 40 that curves from sidewall 24 towards the interior of blower housing 12. In operation, fan 14 draws an airflow 42 into blower housing 12 through air inlet opening 26. Airflow 42 is accelerated around inlet ring 38 where the rapid change in direction can cause airflow 42 to separate at some distance along the curved surface 40 of inlet ring 38. Such separation of airflow 42 causes the formation of eddies and vortexes adjacent a downstream portion of inlet ring 38. These eddies and vortexes cause turbulence in airflow 42 and also cause a decreased cross-sectional area of air inlet opening 26 as seen by airflow 42. The turbulence created by eddies and vortexes in airflow 42 causes fan 14 to operate inefficiently. Vortex generators 16 coupled to surface 40 of inlet ring 38 extend into airflow 42 at varying angles. Vortex generators 16 prevent the separation of airflow 42, as described below, and, therefore, cause fan 14 to operate more efficiently. As used herein "unfavorable flow structures" is used to designate flow structures, such as recirculation, vortexes, turbulence, and eddies, in an airflow that have negative effects on air handling system 10 operation.

Exhaust outlet 34 defines a path for airflow 42 to exit blower housing 12. As shown in FIG. 2, exhaust outlet 34 has a top wall 44, a first sidewall 46, a second sidewall 48, and a bottom wall 50. Each wall, in part, defines an interior surface 52 of exhaust outlet 34. Vortex generators 16 are coupled to interior surface 52 at one or more of top wall 44, first sidewall 46, second sidewall 48, and bottom wall 50. Vortex generators 16 extend into airflow 42. As airflow 42 exits blower housing 12 through exhaust outlet 34, airflow 42 continues in a circular path directed by fan 14 causing unfavorable flow structures to form in airflow 42. Vortex generators 16 function to generate small flow structures to facilitate breaking up unfavorable flow structures. In alternate embodiments, vortex generators 16 are coupled to additional duct sections or components connected to air handling system 10 to facilitate breaking up unfavorable flow structures downstream of exhaust outlet 34. For example, vortex generators 16 are coupled to a diffuser (not shown) that receives airflow 42 after it exits exhaust outlet 34.

In the exemplary embodiment, a vane 54 is coupled to inner surface 29 of exhaust outlet 34. In one embodiment, vane 54 is coupled to inner surface 29 using mechanical fasteners, welds, adhesive, and any other suitable coupling means that enable vortex generators 116 to function as described. In the exemplary embodiment, vane 54 comprises two vane panels 56, 58 for directing airflow 42 out of exhaust outlet 34. In alternate embodiments, vane 54 includes any number of panels and is located anywhere in exhaust outlet 34. Vane panels 56, 58 can be any shape. In the exemplary embodiment, vane panels 56, 58 are flat, rectangular-shaped panels extending from bottom wall 50 to top wall 44. Coupled to vane panels 56, 58 at various angles and extending into the path of airflow 42 are vortex generators 16.

As airflow 42 passes through exhaust outlet 34, vane 54 redirects airflow 42. This redirection generates unfavorable flow structures in airflow 42. Vortex generators 16 also redirect airflow 42, but the redirection is smaller and causes the formation of small flow structures in airflow 42. The small flow structures in airflow 42 help break up the unfavorable flow structures, as described below.

Figure 3:
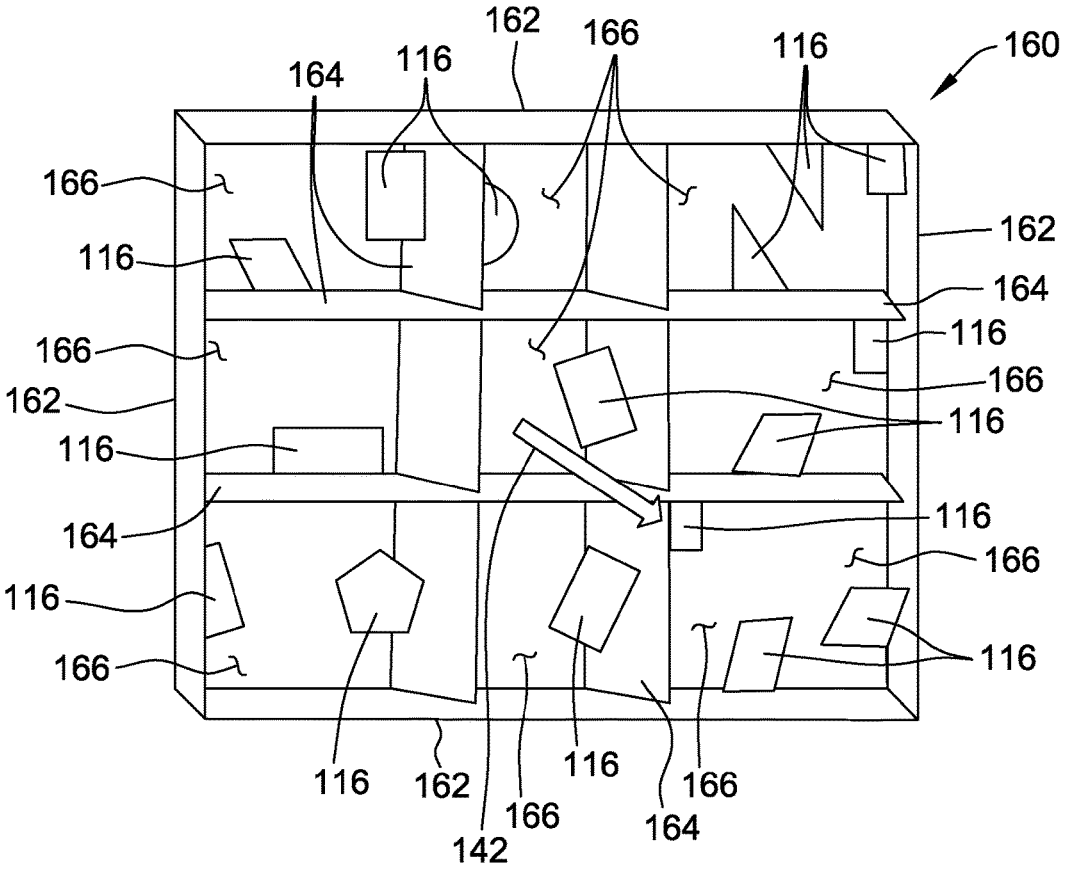
FIG. 3 is a perspective view of a baffle that can be used with the air handling system shown in FIG. 1 having a plurality of vortex generators.

FIG. 3 shows a perspective view of a baffle 160 that can be used with the air handling system shown in FIG. 1 having a plurality of vortex generators 116. Baffle 160 has four walls 162 and four panel sections 164 defining nine openings 166. However, in alternate embodiments, baffle 160 has any number of walls and any number of panels defining any number of openings. When baffle 160 is positioned in a duct system, an airflow 142 passes through openings 166 in baffle 160.

In the exemplary embodiment, vortex generators 116 are coupled to walls 162 and panel sections 164 and extend into the path of airflow 142. Additionally, some vortex generators 116 are coupled to multiple walls 162 and panel sections 164. Vortex generators 116 can be coupled to walls 162 and panel sections 164 using mechanical fasteners, welds, adhesive, and any other suitable coupling means that enable vortex generators 116 to function as described. In the exemplary embodiment, vortex generators 116 are oriented at various angles in relation to walls 162, panel sections 164, and the direction of airflow 142 through openings 166. To generate a multitude of small flow structures in airflow 142, vortex generators 116 are different sizes and have rectangular, circular, triangular, and polygonal shapes. In alternate embodiments, vortex generators 116 can have any size and shape.

Figure 4:
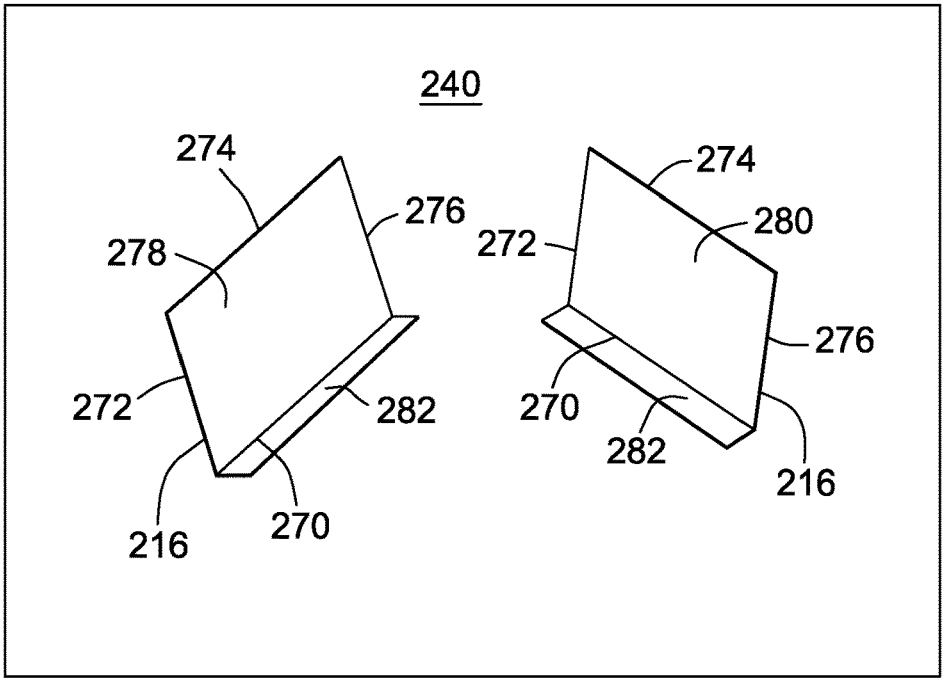
FIG. 4 is a perspective view of a pair of vortex generators that can be used with the air handling system of FIG. 1.

FIG. 4 shows an embodiment of a pair of vortex generators 216 that can be used with air handling system 10. Vortex generators 216 are coupled to a surface 240. In the exemplary embodiment, vortex generators 216 are rectangular plates having four thin edges 270, 272, 274, 276 and two flat faces 278, 280. However, in alternate embodiments, vortex generators may be any shape and have any number of faces and edges. In the exemplary embodiment, vortex generators 216 have base plates 282 coupled to edge 270 oriented perpendicular to flat faces 278, 280. Thus, vortex generators 216 form a substantially L-shaped profile. Base plates 282 of vortex generators 216 are coupled to surface 240. Suitably, base plates 282 are welded or mechanically fastened to surface 240. However, base plates 282 can be coupled to surface 240 using mechanical fasteners, welds, adhesive, and any other suitable coupling means that enable vortex generators 216 to function as described.

Vortex generators 216 can be made of metal, plastic, cardboard, and any other material that enables vortex generators 216 to function as described. In the exemplary embodiment, vortex generators 216 are made of metal.

In an alternate embodiment, vortex generators 216 are punched out of a sheet. Each vortex generator 216 remains coupled to the sheet along only a portion of its perimeter and can be folded over at an angle in relation to the sheet. The sheet can be used as a surface defining a path for airflow 242, with the vortex generators extending into the path. For example, the sheet can be used as a sidewall for a housing in an air handling system. Counterintuitively, the vacuum created adjacent vortex generators 216 will draw air into the housing through the punched-out hole even when airflow 242 is being forced through the housing.

Figure 5:
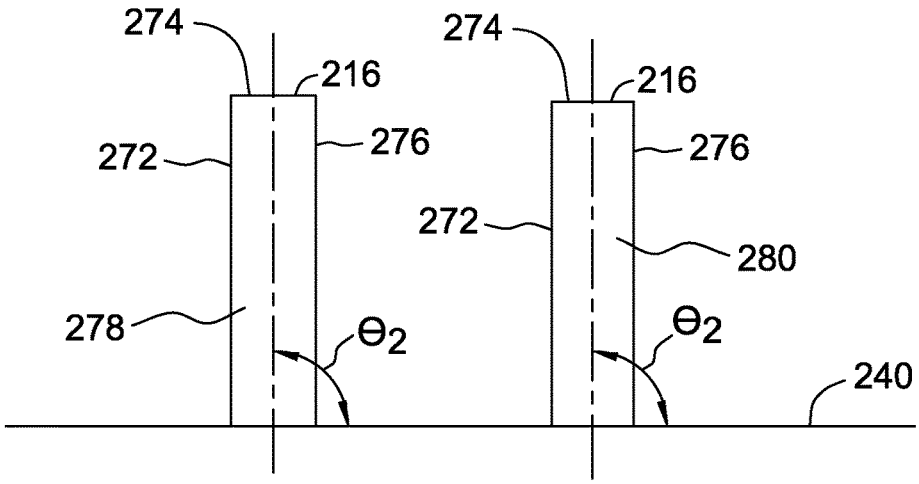
FIG. 5 is a side view of the pair of vortex generators shown in FIG. 4.

FIG. 5 shows a front view of vortex generators 216. Flat faces 278, 280 each form an angle $\theta_2$ with surface 240. Vortex generators 216 can be oriented at any angle $\theta_2$ between about 0 degrees to about 180 degrees. In one suitable embodiment, each angle $\theta_2$ is in the range between about 10 degrees to about 170 degrees. In the exemplary embodiment, angle $\theta_2$ is about 90 degrees, i.e., vortex generators 216 are oriented such that flat faces 278, 280 lie in a plane that is substantially perpendicular to surface 240. In this embodiment, vortex generators 216 extend into the path of an airflow 242 so air strikes flat faces 278, 280.

Figure 6:
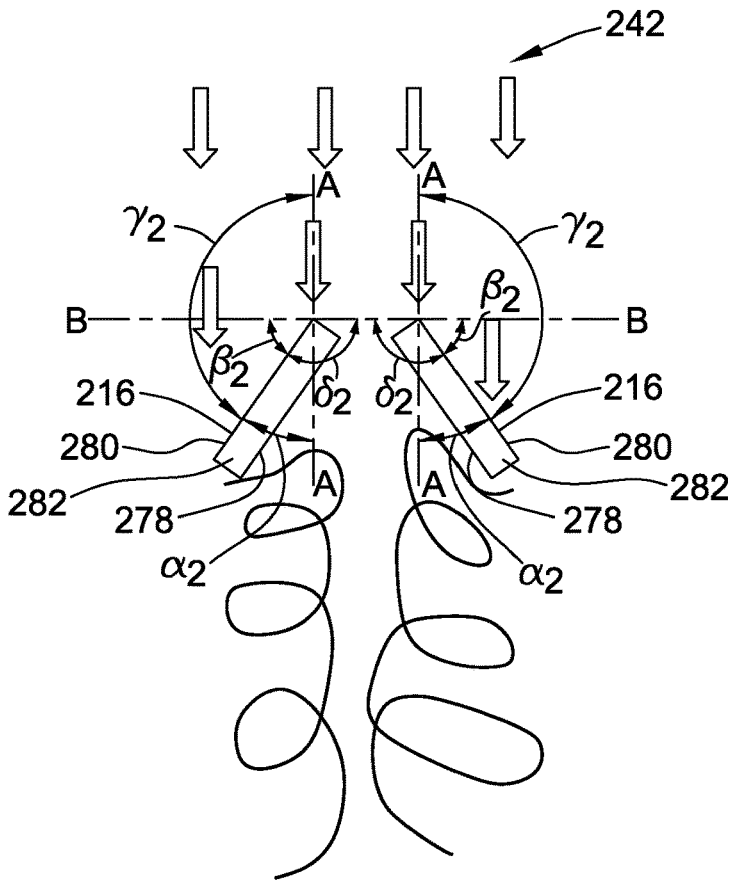
FIG. 6 is a top view of the pair of vortex generators shown in FIG. 4.

FIG. 6 shows a top view of vortex generators 216. As illustrated in FIG. 6, vortex generators 216 deflect airflow 242. As seen in FIG. 6, airflow 242 flows in a direction substantially parallel to flow axes A-A. A perpendicular axis B-B is shown oriented perpendicular to the direction of airflow 242. In the exemplary embodiment, vortex generators 216 form irregular angles $\alpha_2$, $\gamma_2$ with flow axes A-A and irregular angles $\beta_2$, $\delta_2$ with perpendicular axis B-B. As used herein, the term "irregular" means an angle other than 90 degrees. In one suitable embodiment, one of angles $\alpha_2$, $\gamma_2$ between vortex generator 216 and flow axes A-A is in the range between about 5 degrees to about 90 degrees and one of angles $\beta_2$, $\delta_2$ between vortex generator 216 and perpendicular axis B-B is in the range between about 5 degrees to about 90 degrees. In the exemplary embodiment, airflow 242 strikes flat faces 278, 280 and is deflected in a direction different from the original direction of flow. The deflected airflow 242 forms small flow structures, such as eddies and vortexes. Vortex generators 216 block airflow 242 and, thereby, generate a pocket of low-pressure air behind vortex generators 216. After vortex generators 216 deflect airflow 242, airflow 242 rushes in behind vortex generators 216 to fill the low-pressure area. The deflection of airflow 242 and subsequent filling in behind vortex generators 216 creates swirling flow structures, i.e., eddies and vortexes.

Vortex generators 216, shown in FIGS. 4-6, form a counter-rotating pair of vortex generators. Since vortex generators 216 angle away from each other along the direction of airflow 242, airflow 242 that strikes each of vortex generators 216 will rotate in opposite directions. In alternate embodiments, vortex generators 216 may angle towards each other to form co-rotating pairs of vortex generators, where the vortex generators 216 cause the airflow 242 to rotate in the same direction. Alternately, vortex generators 216 may be positioned individually or in odd numbered sets of vortex generators 216 that each cause airflow 242 to rotate in the same direction or different directions.

Figure 7:
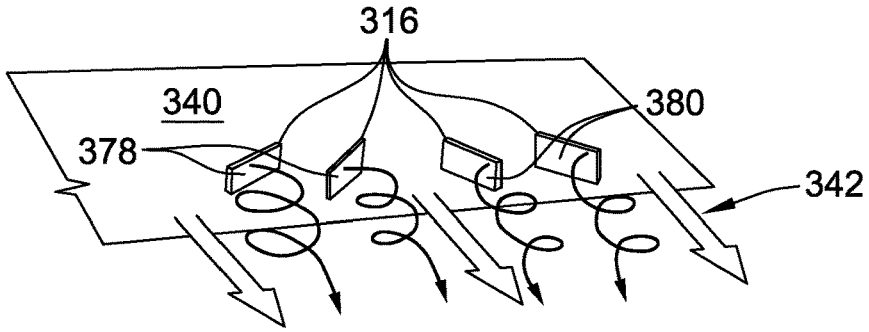
FIG. 7 is a perspective view of a set of vortex generators that can be used with the air handling system of FIG. 1.
Figure 8:
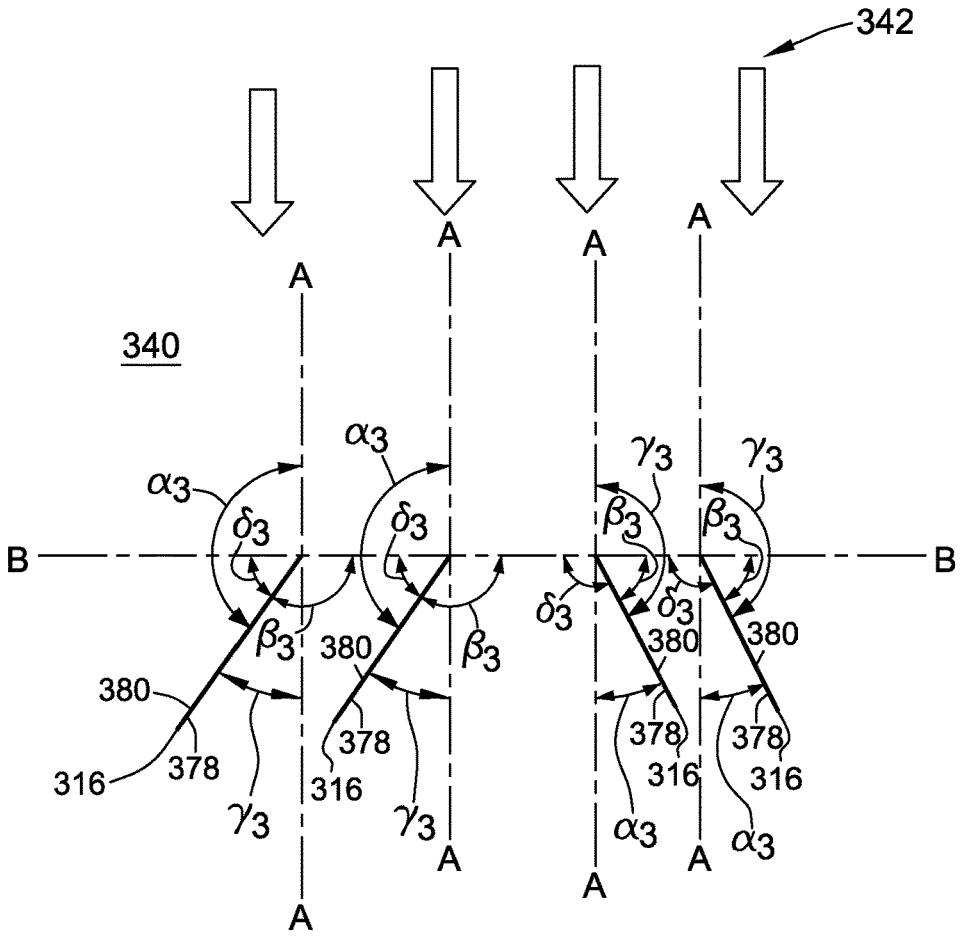
FIG. 8 is a top view of the set of vortex generators shown in FIG. 7.
Figure 13:
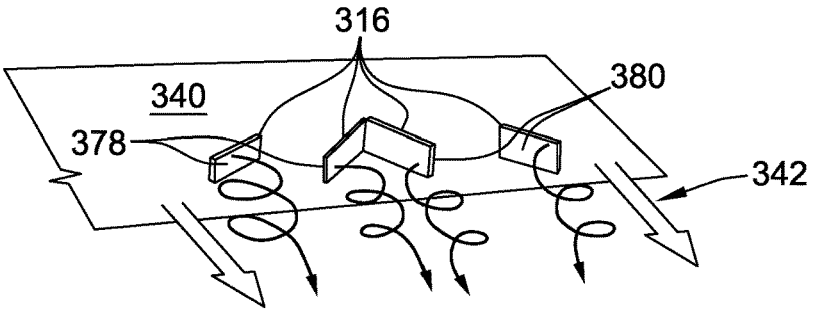
FIG. 13 is a perspective view of an alternative set of vortex generators from those shown in FIG. 7 that can be used with the air handling system of FIG. 1.

FIG. 7 illustrates a perspective view of a set of four vortex generators 316 that can be used with air handling system 10. FIG. 8 shows a plan view of the set of four vortex generators 316. In the exemplary embodiment, vortex generators 316 are oriented on a surface 340. Vortex generators 316 have two flat faces 378, 380, similar to flat faces 278, 280 of vortex generators 216 shown in FIGS. 4, 5, and 6. Flat faces 378, 380 extend into the path of airflow 342 and deflect air striking flat faces 378, 380. In one suitable embodiment, vortex generators 316 form irregular angles $\alpha 3$, $\gamma 3$ with flow axes A-A and irregular angles $\beta 3$, $\delta 3$ with perpendicular axis B-B. In the exemplary embodiment, vortex generators 316 are spaced a distance from each other. In alternate embodiments, vortex generators 316 are touching, as shown in FIG. 13. For example, two vortex generators 316 could be oriented with touching edges to form a general V-shape. The V-shape can form a pocket of low-pressure air behind vortex generators 316 where vortex generators 316 touch to facilitate forming small flow structures. Whether touching or spaced apart, vortex generators 316 can be oriented to form angles between respective vortex generators 316 that are acute, right, obtuse, or straight.

In the exemplary embodiment, vortex generators 316 work in tandem to deflect airflow 342 due to their spacing and orientations. Each vortex generator 316 deflects air that might not have contacted flat faces 378, 380 of another vortex generator 316. Additionally, vortex generators 316 may deflect airflow 342 towards each other, facilitating additional deflections. The deflected air forms small flow structures in airflow 342.

Figure 9:
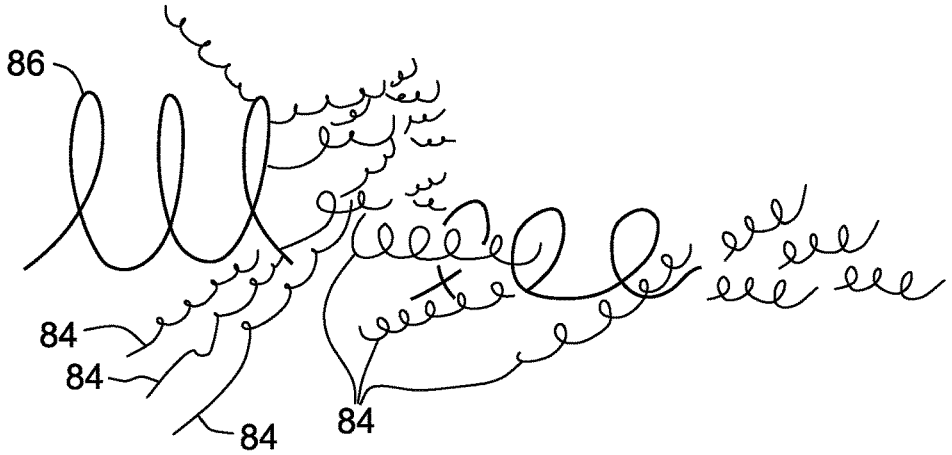
FIG. 9 is a diagram of the interaction of large and small vortexes.

FIG. 9 shows a diagram of the interaction of large and small vortexes. Small flow structures, such as small vortexes 84, generated by vortex generators 16, 116, 216, 316, 416 are smaller than the unfavorable flow structures, such as a large vortex 86, generated by larger air direction means. As illustrated in FIG. 9, when small vortexes 84 collide with large vortex 86, small vortexes 84 facilitate the dissipation of large vortex 86. Small flow structures, such as small vortexes 84, energize the airflow and when combined with other flow structures, such as large vortex 86, can create an energy cascade. In an energy cascade, energy in flow structures is quickly transferred to adjacent flow structures. As energy transfers from the large flow structure to the small vortexes and surrounding flow structures, the large flow structure dissipates due to viscous forces.

For example, centrifugal fans and vanes directing airflow in an HVAC system usually generate unfavorable flow structures. Therefore, when vortex generators 16 are placed in an HVAC system, as shown in FIGS. 1 and 2, the vortex generators will break up the unfavorable flow structures in the system. The breakup of the unfavorable flow structures decreases noise and increases the efficiency of the HVAC system. Vortex generators can also decrease the noise and increase efficiency of the HVAC system by generating an inertial force in airflow through the system. Vortex generators can be placed in new or existing HVAC systems. Vortex generators are a simple and inexpensive way to make any HVAC system, old or new, more efficient and quieter. In one embodiment, vortex generators decrease the sound in an air handling system by 1.9 DB and increase the efficiency of the air handling system by 1.5% CFM/watt in comparison to an air handling system without vortex generators.

Locations, orientations, sizing, and shapes of vortex generators 16, 116, 216, 316, 416 can be calculated using mathematical formulas. Additionally, simulations and testing can be performed to determine locations, orientations, sizing, and shapes of vortex generators 16, 116, 216, 316, 416. Based on current testing and calculations, a randomized disbursement of vortex generators of varying sizes and shapes disposed on multiple surfaces and oriented at different angles in respect to other vortex generators and in respect to the surfaces best generates a multitude of small flow structures. The multitude of small flow structures generated by a set of vortex generators of different locations, orientations, sizing, and shapes cooperate to cause the most effective energy cascade to facilitate breaking up unfavorable flow structures.

Alternately, the vortex generators can be placed on a surface in a generally uniform arrangement to generate an inertial force in airflow over the surface. The inertial force will facilitate a smoother, more efficient airflow by creating a turbulent flow, which is more resistant to separation from the surface. The uniform placement of vortex generators will be especially beneficial on curved surfaces, where airflow has a tendency to separate from the curved surface. By preventing separation of the airflow from the surface, the vortex generators will prevent the formation of unfavorable flow structures.

Figure 10:
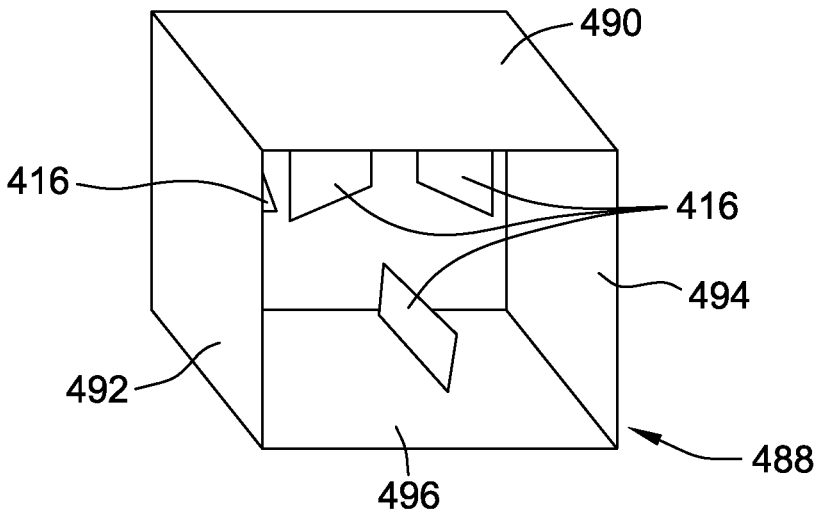
FIG. 10 is a perspective view of a passageway having a plurality of vortex generators.
Figure 11:
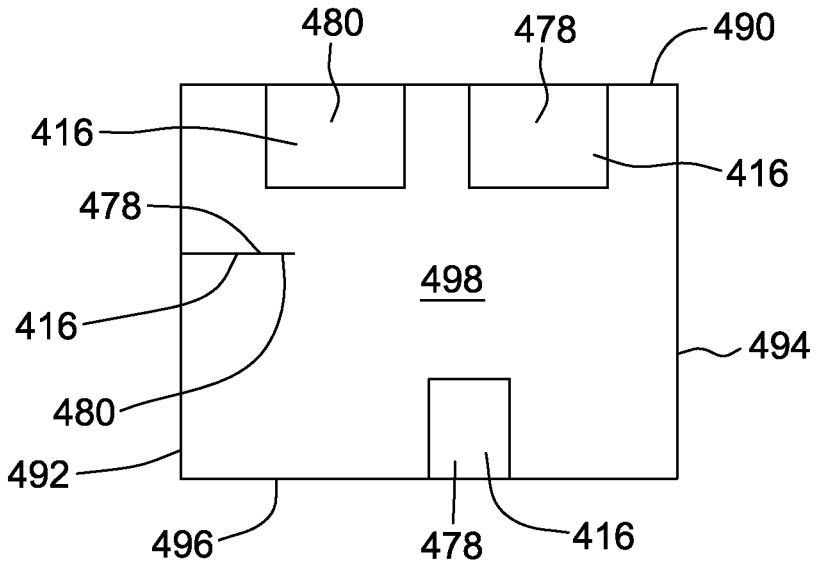
FIG. 11 is a front view of the passageway shown in FIG. 10.
Figure 12:
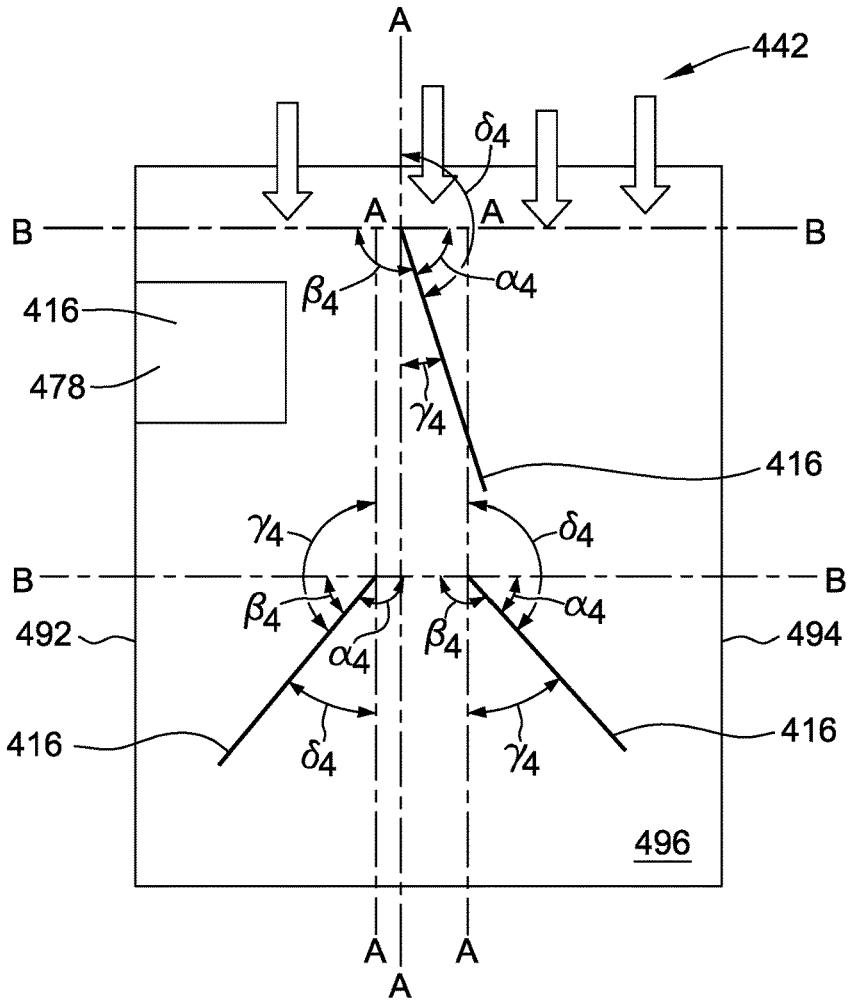
FIG. 12 is a top view of the passageway shown in FIG. 10.

Vortex generators can be used in any passageway to break up unfavorable flow structures and/or generate an inertial force in any flowing fluid. FIG. 10 shows a perspective view of an embodiment of a plurality of vortex generators 416 placed in a passageway 488. FIG. 11 shows a front view of passageway 488. FIG. 12 shows a top view of passageway 488. Passageway 488 has a top wall 490, sidewalls 492, 494, and a bottom wall 496 defining a space 498 for fluid flow 442 to pass through. Top wall 490, sidewalls 492, 494, and bottom wall 496 are connected at right angles forming a rectangular cross-section. However, in alternate embodiments, passageway 488 can have any number of walls and be any shape suitable to function as described, such as, for example, cylindrical.

In the exemplary embodiment, the plurality of vortex generators 416 extends into space 498. A pair of vortex generators 416 is coupled to top wall 490 of passageway 488. A single vortex generator 416 is coupled to bottom wall 496 of passageway 488. Another single vortex generator 416 is coupled to sidewall 492. In alternate embodiments, any number of vortex generators 416 may be coupled to any walls of passageway 488 using mechanical fasteners, welds, adhesive, and/or any other suitable coupling means that enable vortex generators 416 to function as described. Coupling vortex generators 416 to multiple walls facilitates breaking up flow structures that form in different portions of passageway 488.

In the exemplary embodiment, each vortex generator 416 has two flat faces 478, 480, similar to flat faces 278, 280 of vortex generators 216 shown in FIGS. 4, 5, and 6. As illustrated in FIG. 12, vortex generators 416 are oriented at different angles in relation to the direction of fluid flow 442 through passageway 488. Vortex generator 416 on sidewall 492 is in a plane containing flow axis A-A and perpendicular axis B-B. Other vortex generators 416 form irregular angles $\alpha_4$, $\gamma_4$ with flow axis A-A and irregular angles $\beta_4$, $\delta_4$ with perpendicular axis B-B. Vortex generators 416 deflect fluid flow 442 when it strikes flat faces 478, 480. This deflection causes small flow structures that facilitate the breakup of unfavorable flow structures in fluid flow 442. The breakup of unfavorable flow structures will make fluid flow 442 quieter and more efficient.

Some embodiments described herein relate to an HVAC system including a ductwork assembly and methods for circulating air. However, the methods and apparatus are not limited to the specific embodiments described herein, but rather, components of apparatus and/or steps of the methods may be utilized independently and separately from other components and/or steps described herein. For example, the methods may also be used in combination with any passageway for fluid flow, and are not limited to practice with the passageways as described herein. In addition, the exemplary embodiment can be implemented and utilized in connection with many other fluid circulation applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

When introducing elements/components/etc. of the methods and apparatus described and/or illustrated herein, the articles "a", "an", "the", and "said" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

What is claimed is:

1. An air handling system comprising:

a fan configured to circulate air;

a housing comprising:

at least one wall defining a passageway for the air, said at least one wall having a surface and an edge; and at least one vortex generator including:

a substantially rectangular-shaped first plate having a substantially flat face and an edge; and a base plate extending from said first plate edge and coupled to said at least one wall, said at least one vortex generator coupled to said at least one wall, said at least one vortex generator extending at least partially into said passageway, said vortex generator face oriented substantially perpendicular to said surface, said vortex generator edge oriented to form an irregular angle with said wall edge.

2. The air handling system of claim 1, wherein said at least one wall forms an outlet for exhausting the air from said housing, said at least one vortex generator coupled at said outlet.

3. The air handling system of claim 1, wherein said at least one wall forms an inlet configured to draw the air into said housing, said at least one vortex generator coupled to said inlet.

4. The air handling system of claim 1 further comprising a vane disposed in said passageway, said vane configured to direct the air, said at least one vortex generator coupled to said vane.

5. The air handling system of claim 1, wherein said housing comprises four walls joined at approximately right angles, said vortex generator disposed on an inner surface of one of said walls.

6. The air handling system of claim 1, wherein the air flows through the passageway in an airflow direction, said at least one vortex generator being oriented to form an irregular angle with the airflow direction.

7. The air handling system of claim 1, wherein said at least one vortex generator comprises a plurality of vortex generators spaced apart from each other and oriented at irregular angles with respect to each other.

8. The air handling system of claim 7 wherein said at least one wall comprises a first wall and a second wall, one vortex generator of said plurality of vortex generators coupled to said first wall and a different vortex generator of said plurality of vortex generators coupled to said second wall.

9. The air handling system of claim 1 further comprising a vane coupled to said at least one wall, said vane spanning substantially the entirety of the passageway and comprising a panel with a surface for directing airflow, said vortex generator coupled to said vane surface.

10. The air handling system of claim 1, wherein said at least one vortex generator comprises a first vortex generator and a second vortex generator oriented at an irregular angle with respect to said first vortex generator.

11. The air handling duct system of claim 10, wherein said first vortex generator touches said second vortex generator.

12. A method of assembling an air handling system, said method comprising:

providing a fan configured to circulate air;

providing a housing including a wall defining a passageway for the air, the wall having a surface and an edge;

providing a vortex generator including a substantially rectangular-shaped first plate having a substantially flat face and an edge and a base plate extending from the first plate edge; and coupling the base plate to the wall, the vortex generator face oriented substantially perpendicular to the surface, the vortex generator edge oriented to form an irregular angle with the wall edge, the vortex generator extending at least partially into the passageway.

13. The method of claim 12, wherein providing the housing including the wall comprises providing the housing including the wall that defines an inlet for drawing the air into the housing, the vortex generator coupled at the inlet.

14. The method of claim 12, wherein providing the housing including the wall comprises providing the housing including the wall that defines an outlet for exhausting the air from the housing, the vortex generator coupled at the outlet.

15. The method of claim 12 further comprising:

coupling a vane to the wall for channeling airflow; and coupling the vortex generator to the vane.

16. The method of claim 12, wherein providing the vortex generator comprises providing a plurality of vortex generators and coupling the vortex generator edge comprises coupling the plurality of vortex generators to the surface of the wall, each of the plurality of vortex generators having a face oriented substantially perpendicular to the surface.

17. The method of claim 16, wherein coupling the vortex generator edge comprises coupling at least two of the plurality of vortex generators in a substantially uniform placement.

* * * * *